US007520418B2

(12) United States Patent
Juratovac et al.

(10) Patent No.: US 7,520,418 B2
(45) Date of Patent: Apr. 21, 2009

(54) INDEX CARD WITH COLOR BAR

(75) Inventors: Diana W. Juratovac, Columbus, OH (US); Jeffrey T. DeBord, Worthington, OH (US)

(73) Assignee: MeadWestvaco Corporation, Glen Allen, VA (US)

( * ) Notice: Subject to any disclaimer, the term of this patent is extended or adjusted under 35 U.S.C. 154(b) by 124 days.

(21) Appl. No.: 11/129,856

(22) Filed: May 16, 2005

(65) Prior Publication Data

US 2006/0255585 A1 Nov. 16, 2006

(51) Int. Cl.
*G07G 1/00* (2006.01)

(52) U.S. Cl. ..... 235/100; 235/380; 235/487

(58) Field of Classification Search ..... 235/100, 235/380, 487, 486, 457; 283/3, 35–36
See application file for complete search history.

(56) References Cited

U.S. PATENT DOCUMENTS

| | | | | |
|---|---|---|---|---|
| 726,439 | A | 4/1903 | Knapp | |
| 3,780,460 | A * | 12/1973 | Hurt, Jr. | 40/380 |
| 4,031,636 | A | 6/1977 | Hurt, Jr. | |
| 4,445,711 | A * | 5/1984 | Cunningham | 283/117 |
| 4,748,758 | A * | 6/1988 | Gaston | 40/359 |
| 5,180,062 | A * | 1/1993 | Stables | 206/574 |
| 5,358,280 | A * | 10/1994 | Scales | 283/63.1 |
| D352,523 | S | 11/1994 | McCracken | |
| 5,361,904 | A | 11/1994 | Kapec et al. | |
| 5,518,274 | A | 5/1996 | Sato et al. | |
| 5,655,236 | A * | 8/1997 | Murray | 5/495 |
| 5,924,227 | A | 7/1999 | Sommers | |
| 5,926,795 | A * | 7/1999 | Williams | 705/14 |
| 6,732,461 | B2 | 5/2004 | Slattery et al. | |
| 6,863,275 | B2 * | 3/2005 | Chiu et al. | 273/302 |
| 2002/0092217 | A1 * | 7/2002 | Ingram et al. | 40/390 |
| 2005/0012930 | A1 * | 1/2005 | Steinfield et al. | 356/425 |
| 2005/0170174 | A1 * | 8/2005 | Windorski | 428/343 |
| 2007/0033821 | A1 * | 2/2007 | Robertson | 33/562 |

FOREIGN PATENT DOCUMENTS

| | | |
|---|---|---|
| FR | 2738774 | 3/1997 |

OTHER PUBLICATIONS

The Robert-Collins French-English English-French Dictionary, 2002, Harper-Collins Publishers.

The Telephone Directory of Ottawa-Gatineau, 2002-2003.

Examiner's Report issued regarding Canadian Patent Application No. 2,532,947 (Oct. 11, 2007).

Webpage www.viking.com, by Viking Office Products, Advertisement for Oxford® Color-Bar Index Cards (date unknown). Applicants admit the status of this publication as prior art for the limited purpose of examination of this application, but otherwise reserve the right to challenge the status of this publication as prior art.

(Continued)

*Primary Examiner*—Edwyn Labaze

(57) ABSTRACT

An index card including a generally rectangular sheet-like body having an outer perimeter and a surface area on one side thereof of less than about 50 square inches. The card further includes a color bar having a longitudinal axis, and the color bar is located on the sheet-like body immediately adjacent to at least part of the outer perimeter. The longitudinal axis is oriented generally parallel to the at least part of the outer perimeter.

3 Claims, 5 Drawing Sheets

OTHER PUBLICATIONS

Webpage www.pendaflex.com, by Pendaflex, Advertisement for Oxford® Extreme Index Cards (date unknown). Applicants admit the status of this publication as prior art for the limited purpose of examination of this application, but otherwise reserve the right to challenge the status of this publication as prior art.

Webpage www.office1000.com, by Office 1000, Inc., Advertisement for various index cards (date unknown). Applicants admit the status of this publication as prior art for the limited purpose of examination of this application, but otherwise reserve the right to challenge the status of this publication as prior art.

Webpage www.thedailyplanner.com, by The Daily Planner, Advertisement for Advanced Graph Colored Edge Paper (date unknown). Applicants admit the status of this publication as prior art for the limited purpose of examination of this application, but otherwise reserve the right to challenge the status of this publication as prior art.

MeadWestvaco Consumer & Office Products, Color Bordered Filler Paper, (color copy) (date unknown). Applicants admit the status of this reference as prior art for the limited purpose of examination of this application, but otherwise reserve the right to challenge the status of this reference as prior art.

* cited by examiner

INDEX CARD WITH COLOR BAR

The present invention is directed to an index card, and more particularly, to an index card with a color bar printed thereon.

BACKGROUND

Index cards are widely utilized in home, classroom, office and other environments to provide a surface for taking notes and the like. Index cards are typically flat, sheet-like items and may include ruled linings to guide the writing of the user. The relatively small dimensions of the index cards allow them to be easily carried and stored. However, it may be difficult to identify, index, classify and/or catalog index cards in an effective manner. Accordingly, there is a need for an improved index card, as well as an assembly of bound index cards.

SUMMARY

In one embodiment, the present invention is an index card which can be relatively easily identified, indexed, classified and catalogued, as well as an assembly of such index cards bound together. In particular, in one embodiment, the invention is an index card including a generally rectangular sheet-like body having an outer perimeter and a surface area on one side thereof of less than about 50 square inches. The card further includes a color bar having a longitudinal axis, the color bar being located on the sheet-like body immediately adjacent to at least part of the outer perimeter. The longitudinal axis is oriented generally parallel to the at least part of the outer perimeter.

In another embodiment the invention is an index card assembly including a plurality of index cards, each index card having a generally rectangular sheet-like body having an outer perimeter and a surface area on one side thereof of less than about 50 square inches. Each card has a color bar with a longitudinal axis, the color bar being located on the sheet-like body immediately adjacent to at least part of the outer perimeter. The longitudinal axis is oriented generally parallel to the at least part of the outer perimeter. The assembly further includes binding means binding the plurality of index cards together.

DETAILED DESCRIPTION

Figure 2:
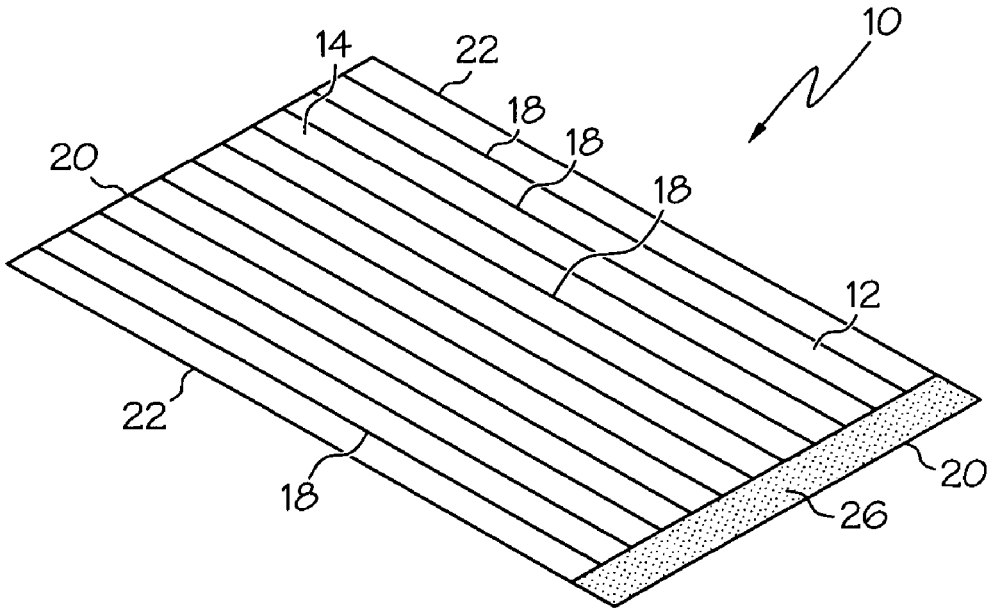
FIG. 2 is an upper perspective view of another embodiment of the card of the present invention.
Figure 3:
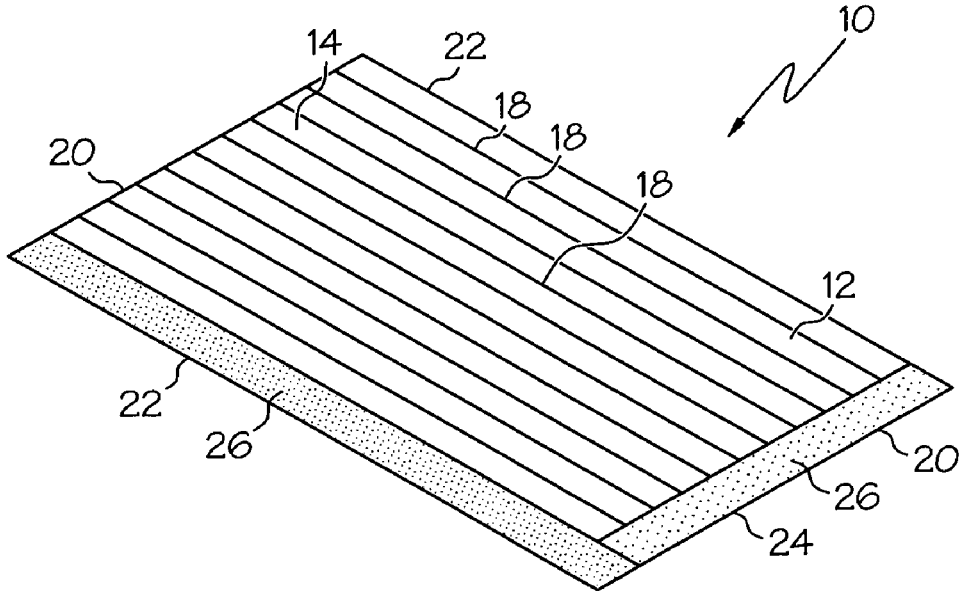
FIG. 3 is an upper perspective view of yet another embodiment of the card of the present invention.
Figure 4:
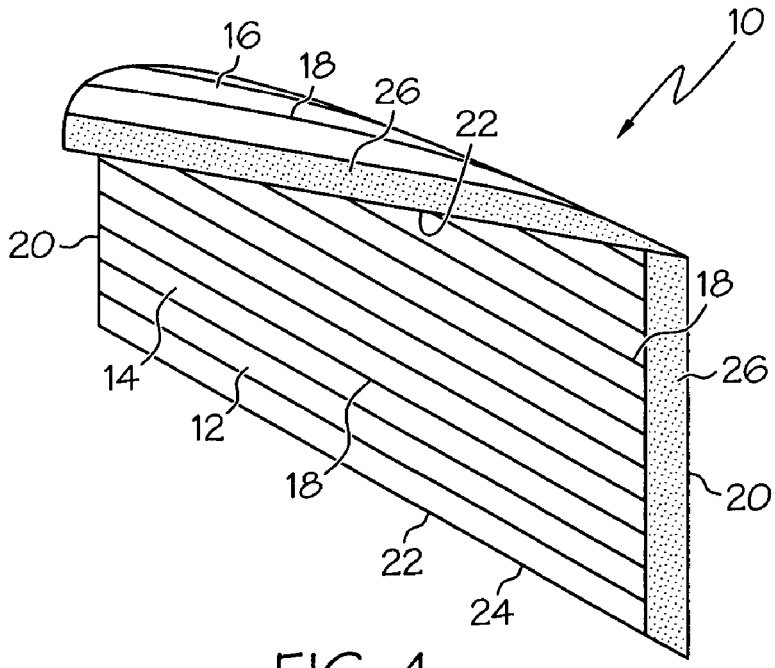
FIG. 4 is a front perspective view of another embodiment of the card of the present invention, wherein the card is bent to illustrate part of both sides thereof.

As shown in FIGS. 1-4, in one embodiment the index card of the present invention, generally designated 10, includes a generally rectangular sheet-like body 12 having a front surface 14 and a back surface 16 (FIG. 4). The card 10 and body 12 may be made of cellulose-based wood fiber pulp, synthetic materials or a blend of pulp and synthetic materials. The card 10 may have a variety of sizes and shapes, but may be of relatively standardized shapes, such as about 3 inches by about 5 inches, about 4 inches by about 6 inches, etc. In any case, the card 10 may have a surface area on one side of less than about 50 square inches.

The card 10 may be relatively thin to provide flexibility to the card. For example, the card 10 may have a thickness of less than about 2 mm, or less than about 1 mm. The card 10 may have a plurality of rulings or guidelines 18 printed thereon which extend across the longitudinal dimension of the card 10 to provide a guide for writing or the like.

Figure 1:
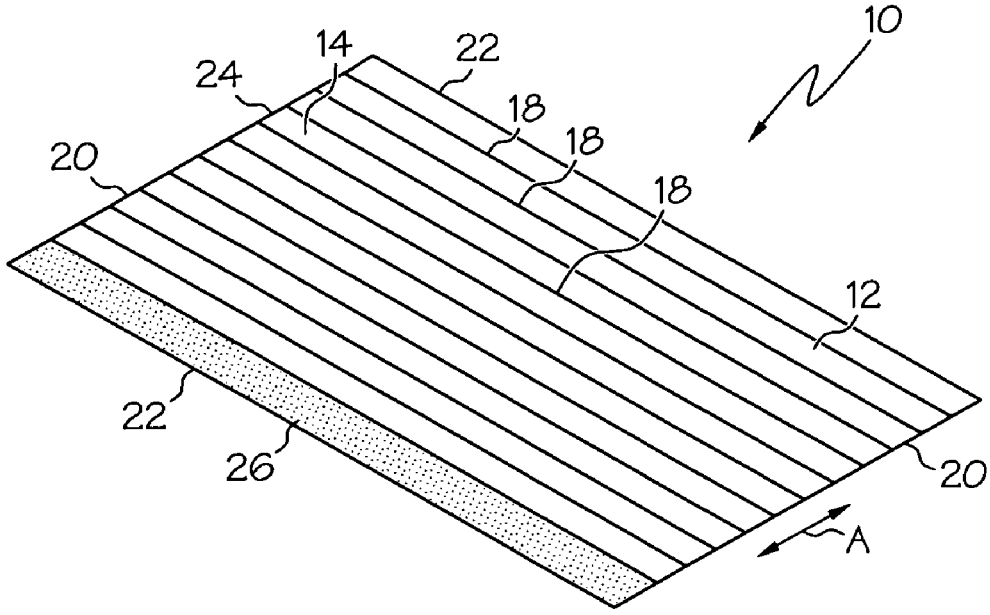
FIG. 1 is an upper perspective view of one embodiment of the card of the present invention.

The card 10 may include a pair of opposed lateral edges 20 and a pair of opposed longitudinal edges 22 which together define an outer perimeter 24 of the sheet-like body 12. As shown in FIG. 1, the card 10 includes a generally rectangular color bar 28 located immediately adjacent to and extending or oriented generally parallel to at least part of the outer perimeter 24. The color bar 26 may be located immediately adjacent to the outer perimeter 24 such that there are substantially no gaps located between the color bar 26 and the outer perimeter 24 or associated edge 20. The color bar 26 of FIG. 1 may extend (i.e., along its longitudinal axis) along the lower longitudinal edge 22. In addition, the color bar 26 may be located immediately adjacent to the entire length of the lower longitudinal edge 22. Alternately, the color bar 26 may extend along or be located immediately adjacent to the majority of the length of any of the edges 20, 22. Furthermore, as can readily be seen in FIGS. 3, 5, and 7, the color bar 26 may be entirely located within the outer perimeter 24 and the associated edges 20, 22.

The color bar 26 can be any of a variety of non-white colors, including but not limited to red, orange, yellow, blue, green, purple, brown, black and the like (black being a color for the purposes of this application and the claims). The remainder of the upper surface 14 of the card 10 of FIG. 1 is white (with the exception of the relatively light ruling lines 18) such that the remainder of the surface area can easily be written upon with a pen, pencil or other marking instrument. Thus, the surface area of the side of the card 10 having the color bar 26 that is not covered by the color bar 26 may be generally white.

The color bar 26 may have a relatively small thickness (i.e., the dimension extending in direction A of FIG. 1). In particular, in one embodiment the color bar 26 has a thickness extending in a transverse direction that is less than about 20% of the dimension of the card 10 extending in the transverse direction (i.e., in FIG. 1 the traverse direction extends along the height of the card 10).

The color bar 26 can be located at a variety of locations. For example, as shown in FIG. 2, rather than being located along a longitudinal edge 22, the color bar 26 can be located along a lateral edge 20 thereof. Furthermore, more than one color bar 26 can be located on a single side of the card 10. For example, as shown in FIG. 3, a color bar 26 is located along the lower longitudinal edge 22, and another color bar 20 is located along the right-side lateral edge 20. When more than one color bar 26 is located on a single side of the card 10, the color bars 26 can be of different colors (as shown in FIG. 3) or can be of the same color.

If desired, both sides 14, 16 of the card 10 may have a color bar 26 located thereon. The color bars 26 can be located in the same corresponding location on both sides, or can be located in different locations. In addition, the various color bars 26 on the differing sides 14, 16 can be made of the same or different colors. For example, when the color bars 26 are located at the same position and are of the same color on both sides 14, 16 thereof, FIGS. 1-3 may accurately illustrate both the front 14 and back 16 of the card 10. Alternately, differing numbers of color bars 26 can be located on the differing sides 14, 16 of the card 10.

Figure 5:
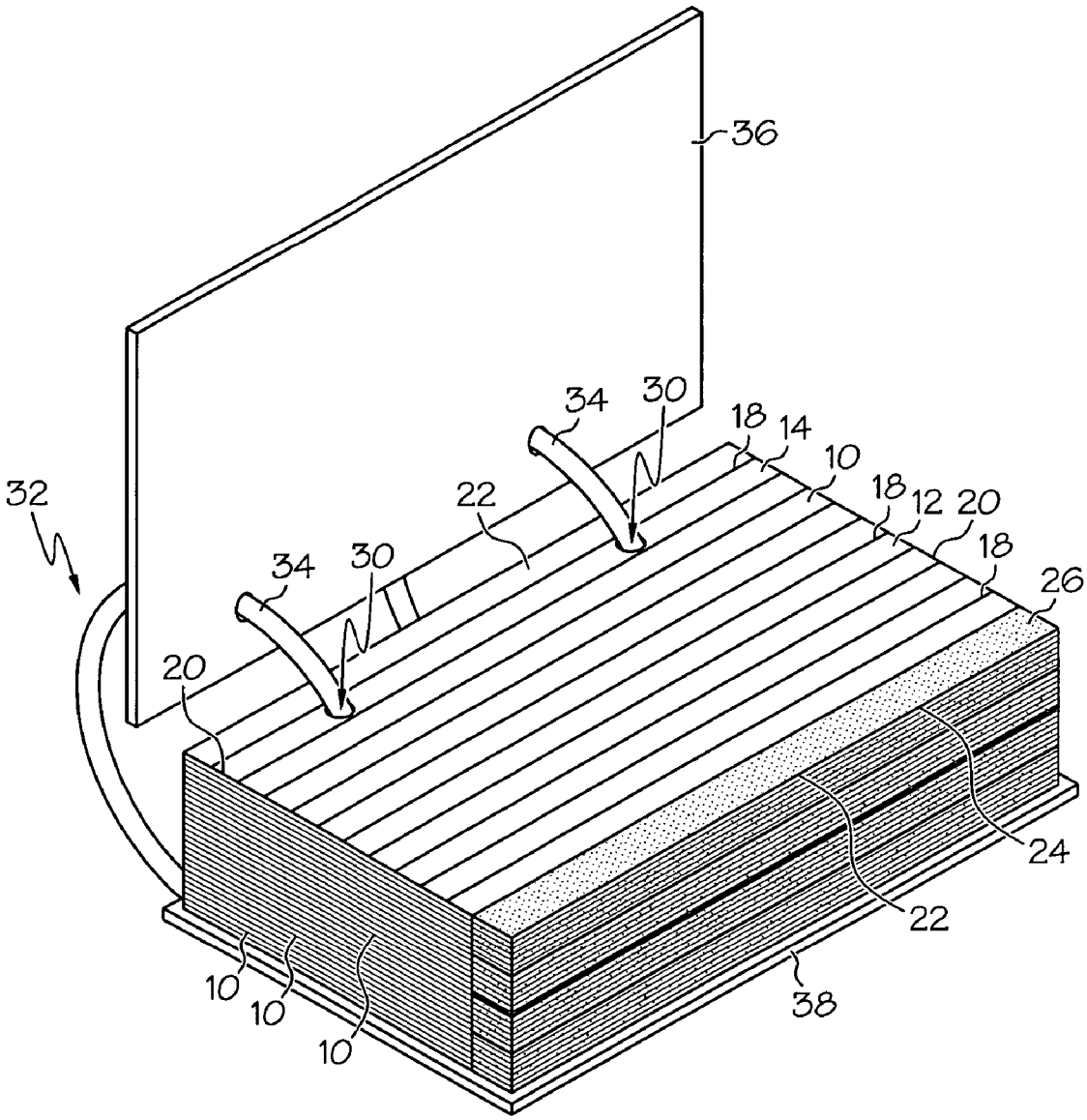
FIG. 5 is a front perspective view of a plurality of cards bound by a binding mechanism.

As shown in FIG. 5, a plurality of cards 10 (such as the cards 10 of FIG. 1) may be bound together. Each card 10 may be aligned and have a pair of binding holes 30 located adjacent to an edge thereof, and may be bound together by a binding mechanism 32 (such as binding rings 34) extending through the openings 30. The binding rings 34 may be able to be opened and closed to allow cards 10 to be added to, removed from, or rearranged within the bound assembly. If desired, front 36 and bottom 38 covers having about the same size and shape as the cards 10 (or slightly larger), but with increased thickness and/or rigidity may be bound to the cards 10 by the binding rings 34.

Figure 6:
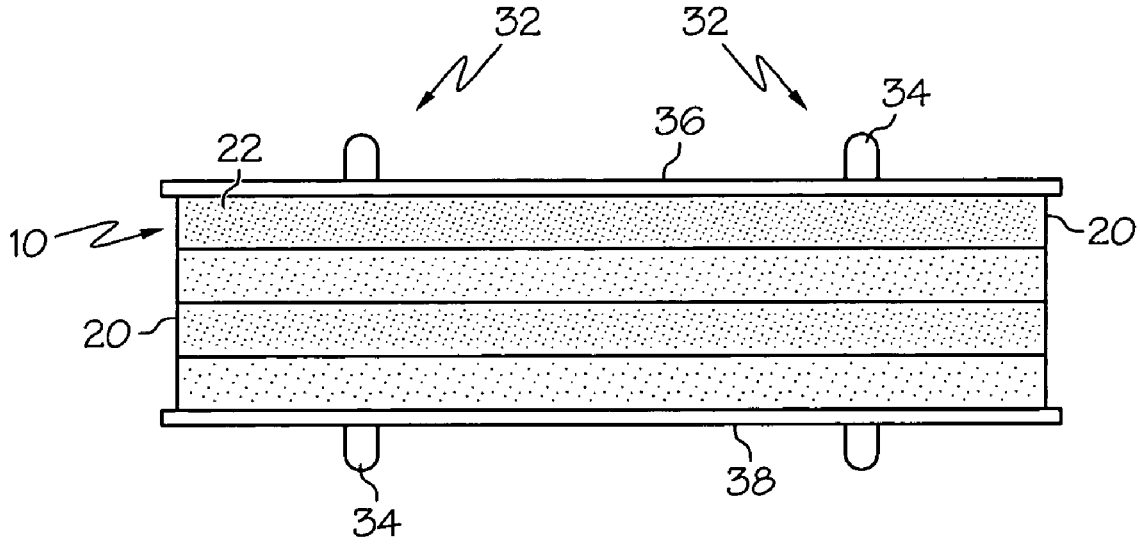
FIG. 6 is an end view of the bound cards of FIG. 5.

As can be seen in FIG. 5, cards 10 having four different colors for their color bars 26 are bound together such that their color bars are generally aligned. The grouping of colors allows a user to quickly and easily identify, organize or classify the cards. For example, all the cards with a color bar 26 of a particular color may correspond to a student's history notes, cards with a color bar 26 of a different color may correspond to geography notes, etc. In this manner, the cards 10 can be easily identified and accessed, even when the assembly of FIG. 5 is closed and only the ends of the cards 10 are visible (as shown in FIG. 6). Alternately, rather than grouping the cards by color 10, the cards 10 with various particular color bars could be dispersed throughout the bound assembly.

Thus, it may be advantageous to place the color bars 26 immediately adjacent to the outer perimeter 24 such that the color bars 26 remain visible, even when the assembly is closed and seen in end view, as shown in FIG. 6. In contrast, if the color bars 26 were to be spaced away from the outer perimeter 26, the color bars 26 may not be visible when the stack of cards 10 is viewed in end view.

Figure 7:
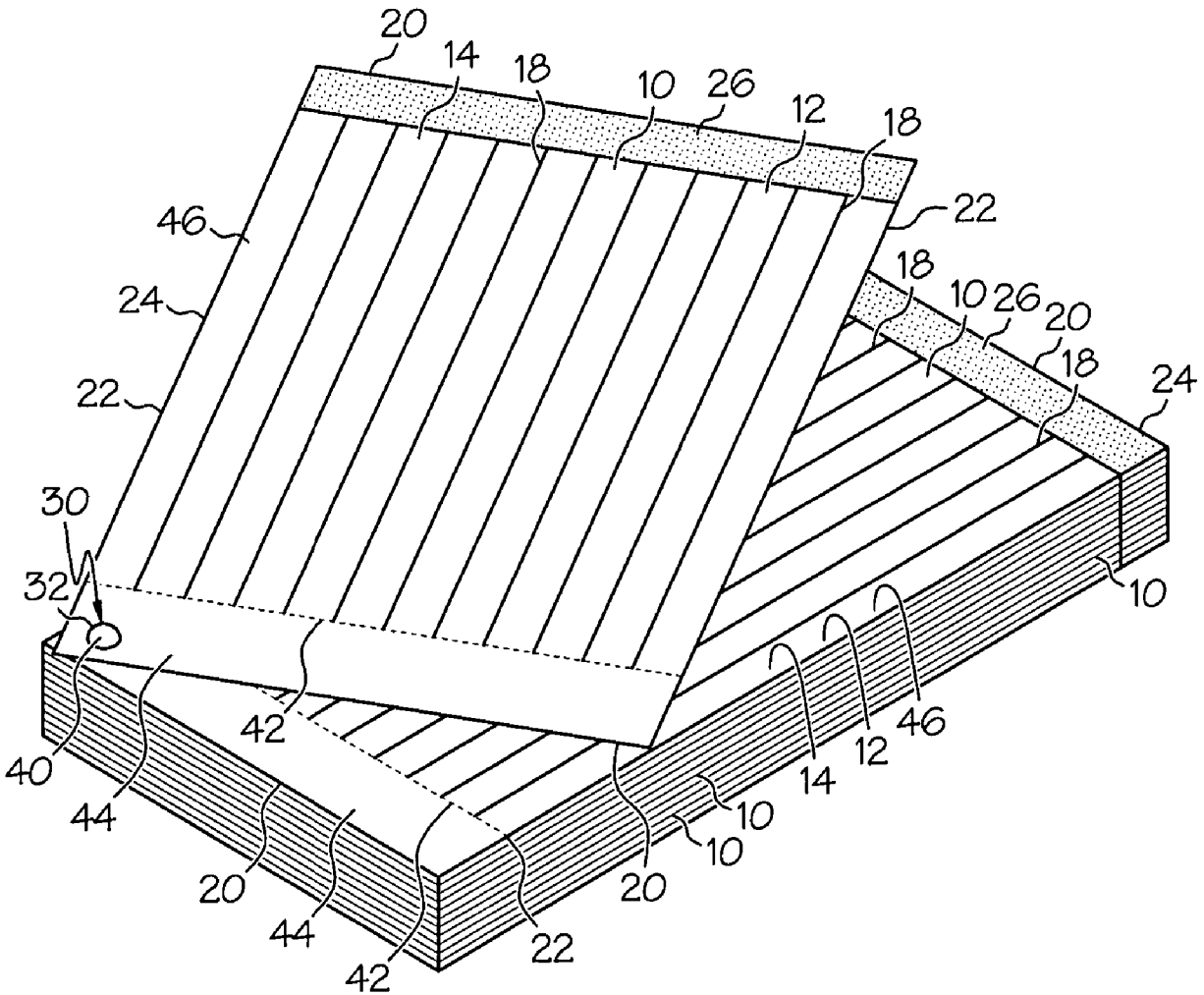
FIG. 7 is an upper perspective view of a plurality of cards bound by an alternate binding mechanism.

As shown in FIG. 7, rather than utilizing the binding rings 34 as a binding mechanism 32, in another embodiment each card 10 includes an opening 30 adjacent to a corner thereof, and a binding mechanism 32 in the form of a post 40 with a pair of rivets located at each end thereof is received through the openings 30. In this manner, each card 10 is pivotable about the binding mechanism 32. In addition, in the embodiment shown in FIG. 7, each card 10 may include a tear guideline 42, such as a perforation line, extending entirely across a dimension of the card 10 (such as the lateral dimension). Each perforation line 42 divides each card 10 into a bound portion 44 (bound to the other cards 10 by the binding mechanism 32) and a removable portion 46. In this manner, each card 10 can be torn along its perforation line 42 and be used separately and apart from the bound assembly.

In the embodiment of FIG. 7, much like the embodiment of FIGS. 5 and 6, cards 10 with various colored bars 26 can be bound together such that the color bars 26 allow a convenient, fast and efficient method of quickly identifying cards 10.

Having described the invention in detail and by reference to the various embodiments, it will be apparent that modifications and variations thereof are possible without departing from the scope of the invention.

What is claimed is:

1. An index card comprising:

a generally rectangular sheet-like body having an outer perimeter and a surface area on one side thereof of less than about 50 square inches; and a color bar having a longitudinal axis, said color bar being generally co-planar with said sheet-like body and located on said sheet-like body immediately adjacent to at least part of said outer perimeter and wherein said longitudinal axis is oriented generally parallel to said at least part of said outer perimeter and wherein said body has a first side and a second side, and wherein said color bar is located on said first side and wherein said index card includes a color bar located on a second side thereof, said color bar of said second side being located immediately adjacent to and extending generally parallel to at least part of said outer perimeter.

2. The index card of claim 1 wherein said color bars of said first and second sides are of substantially the same color.

3. The index card of claim 1 wherein said color bars of said first and second sides extend along generally the same portion of said perimeter.

* * * * *